United States Patent [19]

Olsson

[11] Patent Number: 5,039,018

[45] Date of Patent: Aug. 13, 1991

[54] COMBUSTION DEVICE

[76] Inventor: Odd Olsson, Puoitak, S-971 00 Malmberget, Sweden

[21] Appl. No.: 487,966

[22] PCT Filed: Nov. 10, 1988

[86] PCT No.: PCT/SE88/00602

§ 371 Date: May 14, 1990

§ 102(e) Date: May 14, 1990

[87] PCT Pub. No.: WO89/04440

PCT Pub. Date: May 18, 1989

[30] Foreign Application Priority Data

Nov. 13, 1987 [SE] Sweden ..... 8704444

[51] Int. Cl.[5] ..... B05B 1/34

[52] U.S. Cl. ..... 239/406; 239/403; 239/434.5; 239/490

[58] Field of Search ..... 239/401, 403, 405, 406, 239/434.5, 398, 499, 422, 461, 463, 490

[56] References Cited

U.S. PATENT DOCUMENTS

| | | | |
|---|---|---|---|
| 1,678,459 | 7/1928 | Bowland | 239/403 |
| 1,864,647 | 6/1932 | Geer | 239/434.5 |
| 1,864,795 | 6/1932 | Boyd | 239/405 |
| 2,046,592 | 7/1936 | Tracy | 239/405 |
| 2,545,951 | 3/1951 | Frese et al. | 239/499 |
| 2,815,069 | 12/1957 | Garraway | 239/398 |
| 2,914,257 | 11/1959 | Wiant | 239/401 |
| 4,073,436 | 2/1978 | Behr | 239/434.5 |
| 4,559,009 | 12/1985 | Marino et al. | 239/406 |

*Primary Examiner*—Andres Kashnikow
*Assistant Examiner*—Christopher G. Trainor
*Attorney, Agent, or Firm*—Burns, Doane, Swecker & Mathis

[57] ABSTRACT

The invention relates to a combustion device in which preferably liquid fuel is supplied to nozzle (11,14;11',14') belonging to a burner (1) in order to be mixed with a stream of combustion air after passage of the nozzle, whereafter the fuel air mixture is ignited and burnt in a combustion room (20), the device being of that kind in which the combustion air is conducted through an annular channel (16;16') surrounding the nozzle (11,14;11',14').

The invention is characterized in that the fuel channel (12;12') of the nozzle (11,14;11',14') communicates with the air channel (16;16') by a number of holes (13;13') which debouch at the side of the nozzle (11,14;11',14'), and that the air channel (16;16') in the area of the holes (13;13') has an annular cavity for forming a whirl channel (18;18') for the fuel air mixture.

4 Claims, 3 Drawing Sheets

COMBUSTION DEVICE

This invention relates to a device according to the introductory part of claims 1.

The invention relates more specifically to a new design of oil burners for oil-heated boilers, furnaces and so on.

Burning of pellets is for instance made in belt furnaces where the heating of the furnace is made by burning oil that is squirted into the furnace together with compressed air via a burner nozzle. The effectivity and the oil consumption are depending upon how well the oil is decomposed by the air before burning takes place.

Conventional design of burner nozzles makes that the oil is decomposed into the form of drops. Drawbacks of the known technique is a bad atomization of the oil particles, a high air and oil consumption and a bad adaptability of the flame. Furthermore, the oil burners have a short length of life due to high environment temperatures that demolish the oil burner.

The object of this invention is to provide an improved device of the kind mentioned above and this object is achieved by giving the device the characterizing features mentioned in the claims.

An advantage with the invention in comparison with known technique is that the invention offers a device that makes a high degree of atomization of the fuel possible before the fuel-air mixture leaves the device.

Further advantages of the invention in comparison with known technique is a reduced fuel and air consumption, a longer length of life of the burner nozzle and the burner, a high adaptability of the length and the width of the flame and that the nozzle besides that can be used for solid fuels like pulverized coal fuel.

A further advantage of the invention is that the burner can be used for working temperatures from 0°-1300° C. This has resulted in that bottled gas systems for temperatures up to 100°-150° C. previously used for dry heating of furnaces, burners for thin oil for temperatures up to 600° C. and burners for thick oil for temperatures from 600°-1300° C. have been able to be replaced by one single burner of the kind according to the invention.

Below an embodiment of the invention will be described with reference to the accompanying figures where FIG. 1 schematically in interrupted longitudinal section shows an embodiment of the device according to the invention;

Figure 1:
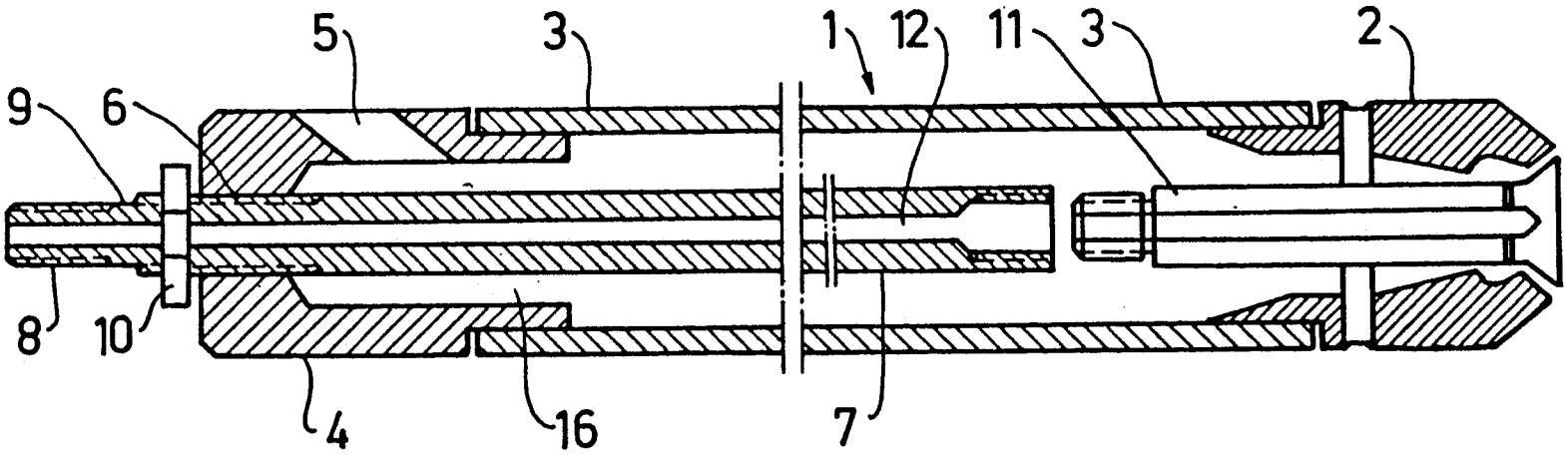

According to FIG. 1 the combustion device comprises a burner house 1 composed of a front burner head 2, a middle cylinder-formed main part 3 and a rear end part 4. The main part 3 is herewith firmly connected to the burner head 2 and the end part 4, respectively. The end part 4 is provided with an air inlet 5 for combustion air from a not shown source of compressed air. This source can for instance be the compressed air system being available at the place where the device is used or a separate compressor. The end part 4 is further provided with a central, coaxially threaded opening 6 for receiving a fuel tube 7 with external threads.

The rear end of the fuel tube 7 serves as a connecting part 8 for a not shown conduit for the fuel which preferably is a liquid fuel, as a rule thick oil, but it is also possible to use a solid fuel, for instance a pulverized coal fuel.

The fuel tube 7 is axially displaceable in the burner house 1 by turning and is provided with a key grip 9 for a suitable not shown turning tool in order to facilitate the turning. A locking nut 10 is applied on the outside of the fuel tube 7 and arranged to lock this one in a desired position. The front end of the fuel tube 7 has internal threads and is intended to be screwed together with an oblong nozzle body 11 having external threads. In FIG. 1 the parts are shown in a condition where they are not screwed together. Of course it is possible to connect the fuel tube 7 with the nozzle body 11 in any other suitable way.

The front part of the combustion device is described in the following with reference to FIG. 2. The fuel tube 7 and nozzle body 11 form a fuel channel 12 extending up to the front part of the nozzle body 11 and debouching at the side of the nozzle body 11 preferably by two radial holes 13 which are evenly distributed round the periphery. Of course, the number of holes can be varied after the need and may for instance consist of six holes, which are evenly distributed round the periphery. The prolongation of the nozzle body 11 widens conically outwards to the area beyond the radial holes 13 for forming a truncated conical body or a nozzle head 14. For guiding the nozzle body 11 there are arranged radial control means 15 firmly connected with the burner head 2 and arandged round the periphery of the nozzle body 11. The control means 15, for instance three and evenly distributed round the periphery, are arranged with a little play towards the nozzle body 11 in order not to prevent the movement in the longitudinal direction of this one. An annular channel 16 for the combustion air is formed between the casing of the burner house 1 and the nozzle body 11 and the fuel tube 7, respectively.

The burner head 2 is in the streaming direction internally formed with a conically narrowing portion or a constriction 17 followed by an annular cavity or a whirl chamber 18. The whirl chamber 18 seen in the stream direction has a cross-section with a certain radius of curvature immediately followed by a cross-section that narrows conically. It is also possible to make the whirl chamber in that way that this one exclusively has a cross-section with a predetermined radius of curvature, that is without any conically narrowing portion. Such a form, however, increases the risk for coatings in the outlet portion of the chamber. The whirl chamber 18 is followed by a cross-section 19 which widens in the streaming direction.

The mentioned conical cross-section 19 cooperates with the nozzle head 14 for forming of a outlet 21 debouching to a combustion room 20. The cross-section of the outlet 21 is in FIGS. 1 and 2 mainly constant but it is of course possible to vary the cross-section and also the extension in the streaming direction of the outlet 21 depending upon operation conditions and desired qualities of the flame. In FIGS. 1, 2 there is shown a nozzle when this one has taken a front end position.

When operating the device air is supplied to the streaming channel 16 via the air intake 5. The velocity of the air stream increases in the area of the constriction 17 depending on the reduced cross-section area and will strongly decrease in the area of the whirl chamber 18 depending upon the sudden increase of the cross-section area, which has the consequence that air whirls are formed in the chamber 18. At the same time as the air is supplied to the streaming channel, fuel, for instance thick oil, is supplied to the fuel channel 12 and is squirted under high pressure through the radial holes 13 and into the chamber 18. As soon as the oil leaves the holes 13 the oil is mechanically decomposed by the turbulent air stream and the oil air mixture is put in whirling movement in the chamber 18, which brings about an atomization of the oil to particle form. Then the oil air mixture is brought to pass through the outlet 21 with an increased streaming velocity as a result in order to enter the combustion room 20, where, due to the reduction of the streaming velocity, a further atomization of the particles is made before the oil air mixture is ignited by means of for instance electric ignition or a particular gas flame (not shown).

Figure 2:
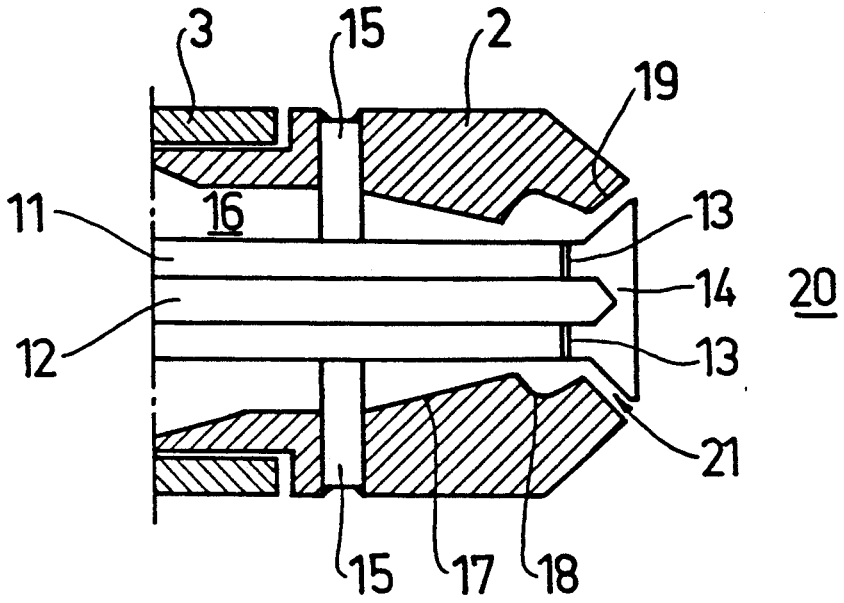
FIG. 2 shows in larger scale in longitudinal section a front portion of the device.
Figure 3:
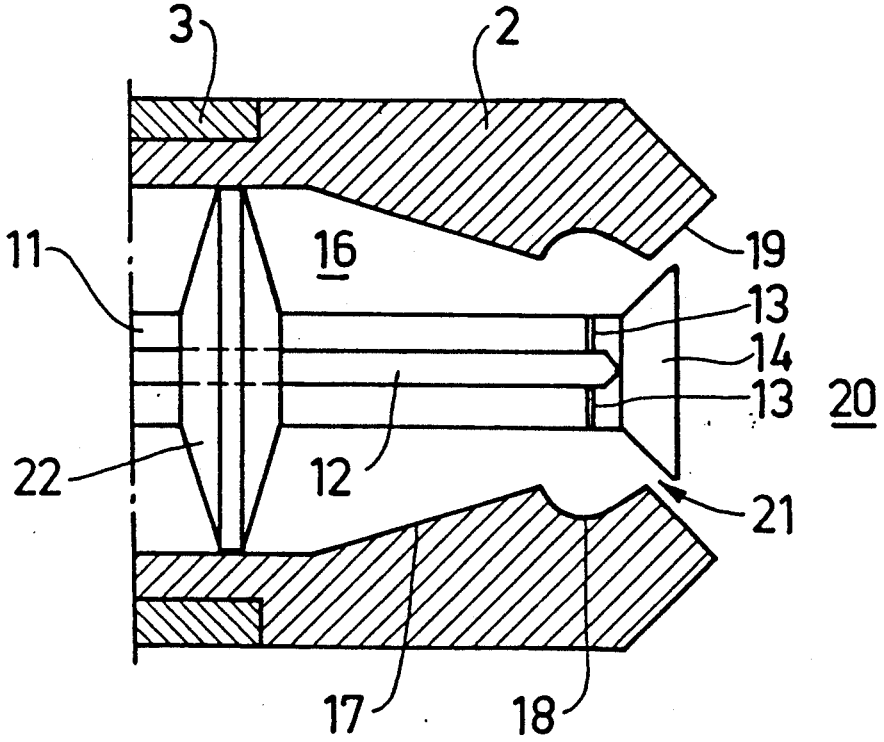
FIG. 3 shows schematically in longitudinal section an alternative embodiment of the front portion.
Figure 4:
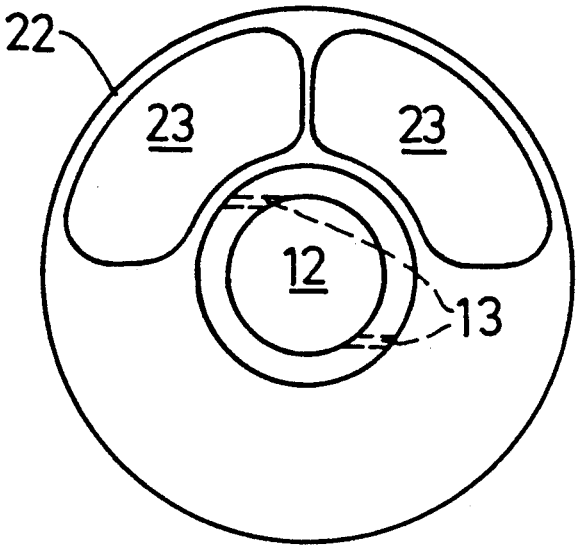
FIG. 4 shows schematically in an end view the front portion according to FIG. 3.

The embodiment according to FIGS. 3, 4 differs from that one in FIG. 2 shown embodiment substantially in that way that instead of radial control means 15 it comprises a single annular control means 22 made in one piece with the nozzle body 11. The control means 22 rests against the wall of the streaming channel 16 with a certain play and is provided with for instance four through-flow openings 23 for air. In FIG. 4 only two of the openings are shown.

In FIG. 3 the nozzle is shown in a rear position. In comparison with the front position shown in FIG. 2 giving a relatively short and wide combustion flame there is received a relatively long and narrow flame with the nozzle in the rear position. The combustion temperature seems to be uninfluenced by the position of the nozzle.

Figure 5:
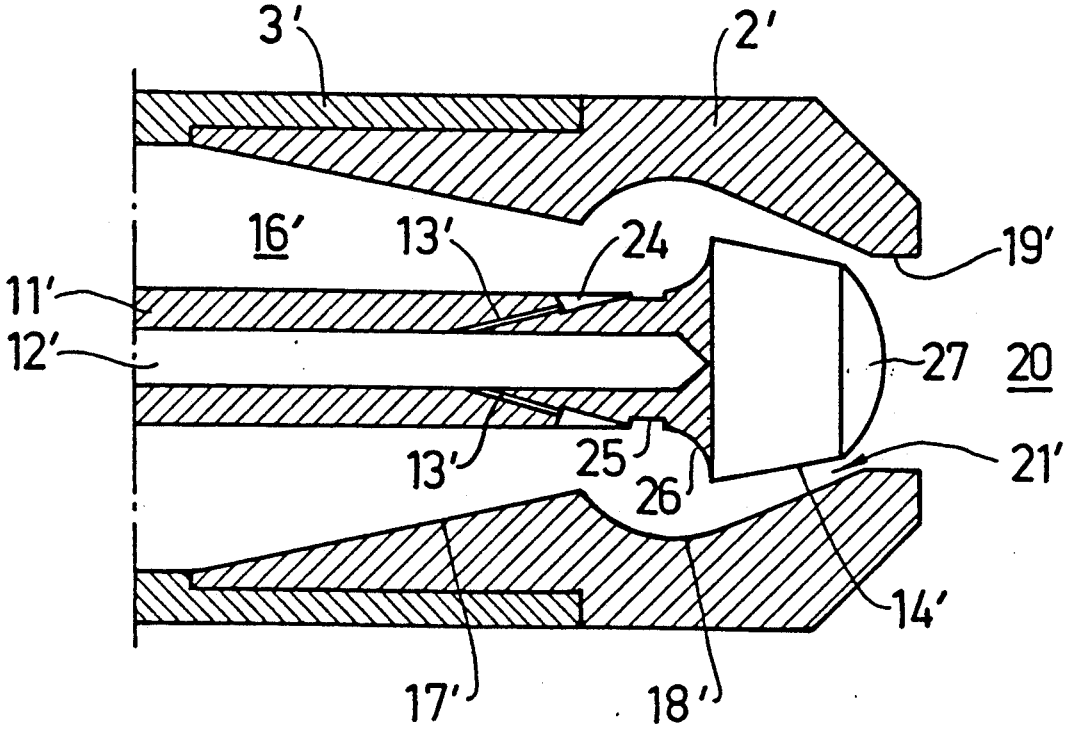
FIG. 5 shows schematically in longitudinal section another alternative embodiment of the front portion.

The embodiment according to FIG. 5 differs from the previous embodiments in that way that the fuel channel 12′ of the nozzle body 11′ communicates with the air channel 16′ by a number, for instance six, oblique holes 13′ distributed round the periphery, which holes debouch in a peripheral groove 24 at the side of the nozzle body 11′. The nozzle body 11′ is further provided with a key grip 25 in order to facilitate turning and by that an axial displacement of the nozzle body 11′ in relation to the burner head 2′. The nozzle head 14′, which is connected to the nozzle body 11′ by a peripherally chamfered groove 26, is made conically narrowing in the streaming direction and has further a spherical top 27.

The constriction 17′ and the whirl chamber 18″ are made in the same way as in the previous embodiments and the chamber is followed by an outlet part 19′ with a constant cross-section. The operation way of the embodiment according to FIG. 5 corresponds to the operation way of the previous embodiments but has a higher capacity.

As has been mentioned above the device according to the invention makes possible to reach a high degree of atomization of the fuel. This is especially important when thick oil is used as fuel. The thick oil contains relatively large particles and is not very clean, which makes that it is very easily carbonized, that it gets stuck during the combustion, which appears in the form of coatings. By arranging a whirl chamber of the kind according to the invention the formation of coatings is prevented.

The invention is not limited to the shown and described embodiments, but changes and modifications of these are possible within the scope of the following claims.

I claim:

1. A combustion device comprising a burner housing, a nozzle received in said burner housing, said nozzle being adapted to receive fuel which, after passage through the nozzle, is mixed with a stream of combustion air so that a resulting fuel-air mixture can be ignited and burnt, said nozzle comprising an oblong, generally cylindrical nozzle body and a nozzle head integrally formed with the nozzle body, an annular channel surrounding the nozzle and through which combustion air can be conducted, said nozzle being provided with a fuel channel that extends along the nozzle body and a plurality of holes that debouch to the side of the nozzle body so as to communicate the fuel channel with the annular channel, said annular channel being provided with an annular cavity in an area adjacent the holes that debouch to the side of the nozzle body, said annular cavity defining a whirl cavity for the air-fuel mixture, said burner housing being provided with a burner head adjacent one end, the annular channel in an area adjacent the burner head including a generally conically narrowing part that narrows toward a free end of the burner head in the streaming direction, said whirl chamber following the conically narrowing part in the streaming direction, said whirl chamber having a cross-section in the streaming direction that includes a portion having a predetermined radius of curvature immediately followed by a generally conically narrowing cross-section and an outlet part, said nozzle head cooperating with the burner head for forming the outlet part.

2. The combustion device according to claim 1, wherein said plurality of holes include two holes positioned in a common plane that is substantially perpendicular to the fuel channel, said holes being substantially evenly distributed about a periphery of the nozzle body.

3. The combustion device according to claim 1, wherein said holes are substantially evenly distributed about a periphery of the nozzle body and open into a peripheral groove formed in an outer peripheral surface of the nozzle body.

4. The combustion device according to claim 1, wherein said nozzle body is displaceably positioned in a longitudinal direction and is guided radially by control means.

* * * * *